US012753575B2

(12) United States Patent
Kageyama et al.

(10) Patent No.: US 12,753,575 B2
(45) Date of Patent: Oct. 6, 2026

(54) POWER FEEDING UNIT AND SWIVEL JOINT

(71) Applicant: KOMATSU LTD., Tokyo (JP)

(72) Inventors: Masato Kageyama, Tokyo (JP); Jun Nabata, Tokyo (JP)

(73) Assignee: KOMATSU LTD., Tokyo (JP)

( * ) Notice: Subject to any disclaimer, the term of this patent is extended or adjusted under 35 U.S.C. 154(b) by 32 days.

(21) Appl. No.: 19/104,852

(22) PCT Filed: Aug. 3, 2023

(86) PCT No.: PCT/JP2023/028397
§ 371 (c)(1),
(2) Date: Feb. 19, 2025

(87) PCT Pub. No.: WO2024/057761
PCT Pub. Date: Mar. 21, 2024

(65) Prior Publication Data

US 2026/0055574 A1 Feb. 26, 2026

(30) Foreign Application Priority Data

Sep. 13, 2022 (JP) ..... 2022-144974

(51) Int. Cl.
*E02F 9/12* (2006.01)
*E02F 9/22* (2006.01)
(Continued)

(52) U.S. Cl.
CPC ..... *E02F 9/123* (2013.01); *E02F 9/2275* (2013.01); *E02F 9/26* (2013.01); *E02F 9/2095* (2013.01)

(58) Field of Classification Search
CPC . E02F 9/123; E02F 9/2275; E02F 9/26; E02F 9/2095; E02F 9/121; E02F 9/006; H01F 38/18
See application file for complete search history.

(56) References Cited

U.S. PATENT DOCUMENTS

2013/0234507 A1 9/2013 Kim
2021/0003219 A1 1/2021 Michikami et al.
(Continued)

FOREIGN PATENT DOCUMENTS

JP S51-066965 U 5/1976
JP S63-266292 A 11/1988
(Continued)

*Primary Examiner* — Daniel Cavallari
(74) *Attorney, Agent, or Firm* — Troutman Pepper Locke LLP

(57) ABSTRACT

Provided is a power feeding unit mounted on a swivel joint, the power feeding unit including: a rotary transformer that is coupled to an upper swing body and a lower traveling body of a work vehicle, respectively; an oscillation circuit that is coupled to the upper swing body, converts electric power into an alternating current, and supplies the alternating current to the rotary transformer; and a smoothing circuit that is coupled to the lower traveling body and converts electric power output from the rotary transformer into a direct current, in which an electrode on a negative side of the smoothing circuit is electrically coupled to a housing of the lower traveling body, and an electrode on a positive side of the smoothing circuit is taken out from a lower portion of the swivel joint via a cable inserted through a pipe provided inside the swivel joint along an axial direction.

15 Claims, 5 Drawing Sheets

(51) Int. Cl.
*E02F 9/26* (2006.01)
*E02F 9/20* (2006.01)

(56) References Cited

U.S. PATENT DOCUMENTS

| | | | | |
|---|---|---|---|---|
| 2021/0159736 | A1* | 5/2021 | Miyamoto | H01F 27/2871 |
| 2021/0170890 | A1* | 6/2021 | Iyer | B60L 53/14 |
| 2022/0136208 | A1 | 5/2022 | Okada et al. | |
| 2023/0265639 | A1 | 8/2023 | Yonekura et al. | |
| 2025/0187091 | A1* | 6/2025 | Zimmer | B06B 1/0614 |

FOREIGN PATENT DOCUMENTS

| | | | |
|---|---|---|---|
| JP | H06-228989 | A | 8/1994 |
| JP | H11-029960 | A | 2/1999 |
| JP | H11-066485 | A | 3/1999 |
| JP | 2014-505185 | A | 2/2014 |
| WO | 2019/230507 | A1 | 12/2019 |
| WO | 2020/189246 | A1 | 9/2020 |
| WO | 2022/071426 | A1 | 4/2022 |

* cited by examiner

POWER FEEDING UNIT AND SWIVEL JOINT

FIELD

The present invention relates to a power feeding unit and a swivel joint.

BACKGROUND

For example, in a swivel joint of a work vehicle including an upper swing body such as an excavator and a lower traveling body, a plurality of hydraulic pipes are rotatably disposed in order to control a motor, a blade, and the like. As a result, the swivel joint is provided with a plurality of hydraulic oil flow paths through which high-pressure and high-speed hydraulic oil can pass. A technique using a rotary transformer for transmitting electric power from an upper rotating body side to the lower traveling body side of the work vehicle is known.

CITATION LIST

Patent Literature

Patent Literature 1: JP S63-266292 A

SUMMARY

Technical Problem

When electric power is transmitted by using the rotary transformer, at least two cables are required inside the swivel joint because the transmitted electric power is an alternating current. In the technique described in Patent Literature 1, a cable that transmits the output from the rotary transformer inside the swivel joint while maintaining the alternating current is installed. Therefore, a two-core cable is disposed inside the swivel joint.

However, in a case where a cable hole is newly provided inside the swivel joint, a wall thickness of the swivel joint is reduced. As a result, strength of the swivel joint may decrease. In addition, when a piping pipe is provided inside the hydraulic oil flow path of the swivel joint, an area of the hydraulic oil flow path may be reduced by the piping pipe, leading to an increase in pressure loss.

An aspect of the present invention is to suppress a decrease in strength of a swivel joint and to suppress a decrease in an area of a hydraulic oil flow path of the swivel joint.

Solution to Problem

According to an aspect of the present invention, a power feeding unit mounted on a swivel joint of a work vehicle, the power feeding unit comprises: a rotary transformer that is coupled to each of an upper swing body and a lower traveling body of the work vehicle; an oscillation circuit that is coupled to the upper swing body, converts electric power into an alternating current, and supplies the alternating current to the rotary transformer; and a smoothing circuit that is coupled to the lower traveling body and converts electric power output from the rotary transformer into a direct current, wherein an electrode on a negative side of the smoothing circuit is electrically coupled to a housing of the lower traveling body, and an electrode on a positive side of the smoothing circuit is taken out from a lower portion of the swivel joint via a cable inserted through a pipe provided inside the swivel joint along an axial direction.

According to another aspect of the present invention, a swivel joint comprises: the power feeding unit; a rotor; a shaft disposed in a bore of the rotor; and a hydraulic oil flow path provided inside the shaft along an axial direction.

Advantageous Effects of Invention

According to the aspect of the present invention, it is possible to suppress a decrease in strength of a swivel joint and to suppress a decrease in an area of a hydraulic oil flow path of the swivel joint.

DESCRIPTION OF EMBODIMENTS

Hereinafter, an embodiment according to the present invention will be described with reference to the drawings, but the present invention is not limited to the embodiment. Components of the embodiment described below can be appropriately combined. In addition, some components may not be used.

Embodiment

<Work Vehicle>

Figure 1:
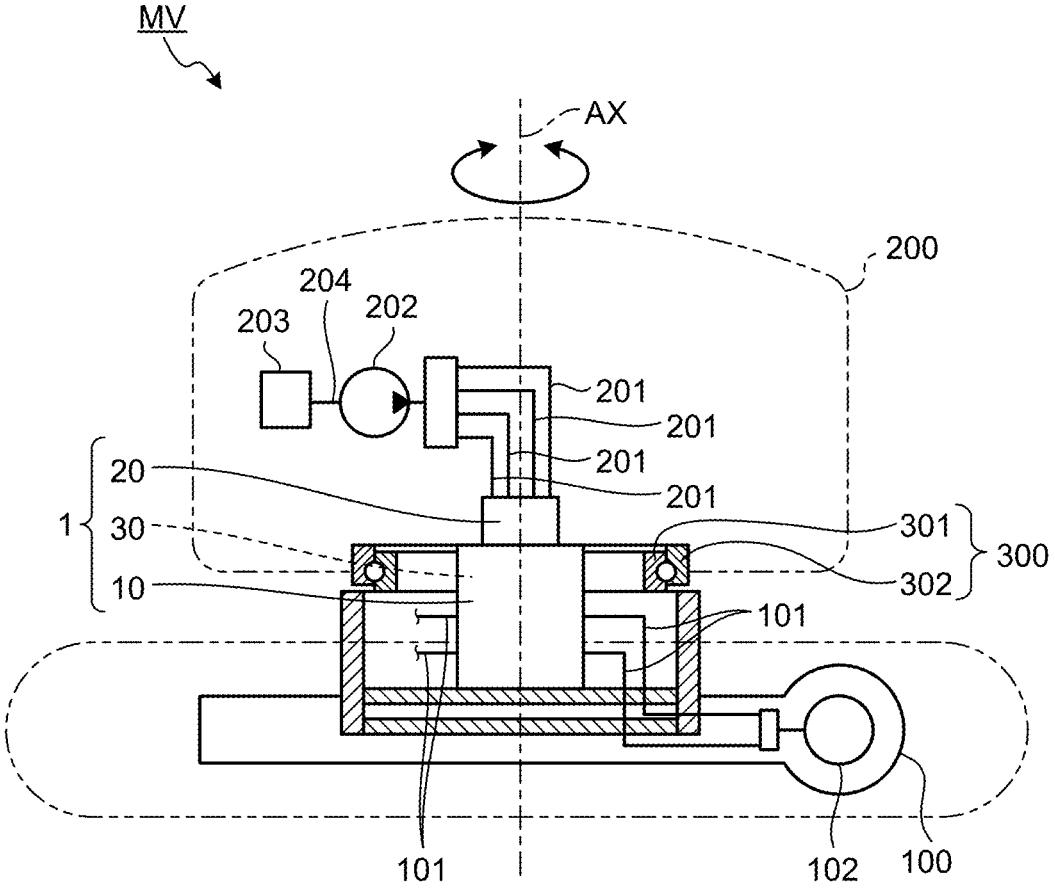
FIG. 1 is a view schematically illustrating a work vehicle according to an embodiment.

FIG. 1 is a view schematically illustrating a work vehicle according to an embodiment. A work vehicle MV includes a lower traveling body 100, an upper swing body 200, a rotation mechanism 300, and a swivel joint 1. The upper swing body 200 is supported by the lower traveling body 100 so as to be able to swing. The work vehicle MV is, for example, a work vehicle including the upper swing body 200 such as an excavator and the lower traveling body 100.

The lower traveling body 100 and the upper swing body 200 are connected via the rotation mechanism 300 and the swivel joint 1. With the rotation mechanism 300 and the swivel joint 1, the upper swing body 200 can swing about a swing axis AX with respect to the lower traveling body 100.

The upper swing body 200 is provided with a hydraulic pump 202 and a hydraulic oil tank 203. The lower traveling body 100 is provided with a hydraulic motor 102. The hydraulic pump 202 and the swivel joint 1 are coupled via tubes 201. The swivel joint 1 and the hydraulic motor 102 are coupled via tubes 101. The hydraulic oil tank 203 stores hydraulic oil. The hydraulic oil stored in the hydraulic oil tank 203 is supplied to the hydraulic pump 202 via an oil path 204. The hydraulic pump 202 discharges the hydraulic oil supplied from the hydraulic oil tank 203. The hydraulic oil discharged from the hydraulic pump 202 is supplied to the hydraulic motor 102 via the tubes 201, an oil path 30 provided in the swivel joint 1, and the tubes 101. When the hydraulic oil discharged from the hydraulic pump 202 is supplied to the hydraulic motor 102 and the hydraulic motor 102 is driven, the lower traveling body 100 travels. The hydraulic oil delivered from the hydraulic motor 102 is returned to the hydraulic oil tank 203 via an oil path (not illustrated).

The rotation mechanism 300 connects the lower traveling body 100 and the upper swing body 200. The rotation mechanism 300 has an inner ring member 301 and an outer ring member 302. The outer ring member 302 is disposed around the inner ring member 301. The inner ring member 301 and the outer ring member 302 rotate relative to each other about the swing axis AX. The inner ring member 301 is fixed to the lower traveling body 100. The outer ring member 302 is fixed to the upper swing body 200.

<Swivel Joint>

Figure 2:
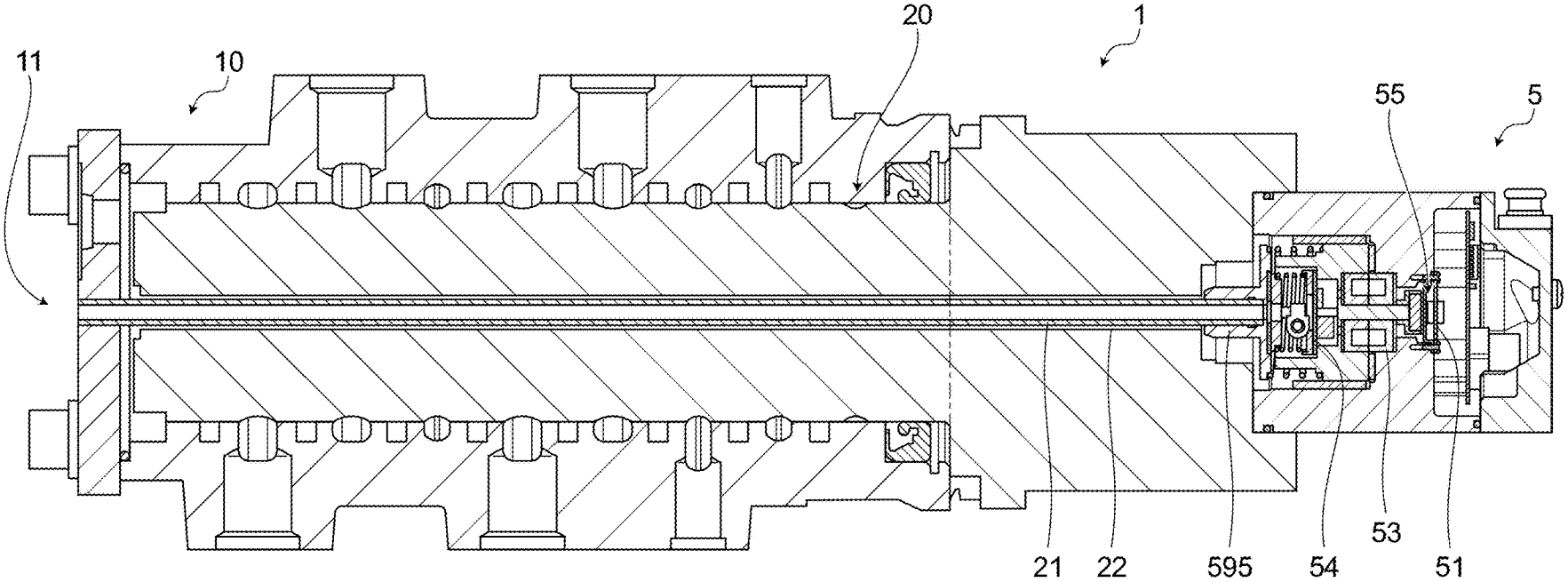
FIG. 2 is a side cross-sectional view illustrating a swivel joint according to the embodiment.

FIG. 2 is a side cross-sectional view illustrating the swivel joint according to the embodiment. The swivel joint 1 connects the lower traveling body 100 and the upper swing body 200. The swivel joint 1 has a rotor 10 and a shaft 20 rotatably supported by the rotor 10. The rotor 10 and the shaft 20 rotate relative to each other about the swing axis AX. The rotor 10 is fixed to the lower traveling body 100. The shaft 20 is fixed to the upper swing body 200. The rotor 10 may be fixed to the upper swing body 200, and the shaft 20 may be fixed to the lower traveling body 100.

A hydraulic oil flow path 22 penetrating in the axial direction is provided inside the shaft 20 of the swivel joint 1. A pipe 21 is disposed inside the hydraulic oil flow path 22. A space between the hydraulic oil flow path 22 and the pipe 21 can also be used as a flow path of the hydraulic oil. In the embodiment, the hydraulic oil is coupled to a drain circuit returning from the hydraulic motor 102 to the hydraulic oil tank 203. The pipe 21 is formed in a hollow tubular shape. The pipe 21 is formed of, for example, a conductive material such as a metal material. A cable for supplying electric power from the power feeding unit 50 of a power feeding system 5 to the lower traveling body 100 is inserted into the pipe 21. The pipe 21 is coupled to a lower portion 11 of the rotor 10 of the swivel joint 1 in a state where a lower end portion of the pipe 21 is opened. The cable inserted into the pipe 21 is taken out from the lower end portion of the pipe 21. The cable taken out supplies electric power to the lower traveling body 100.

<Power Feeding System>

Figure 3:
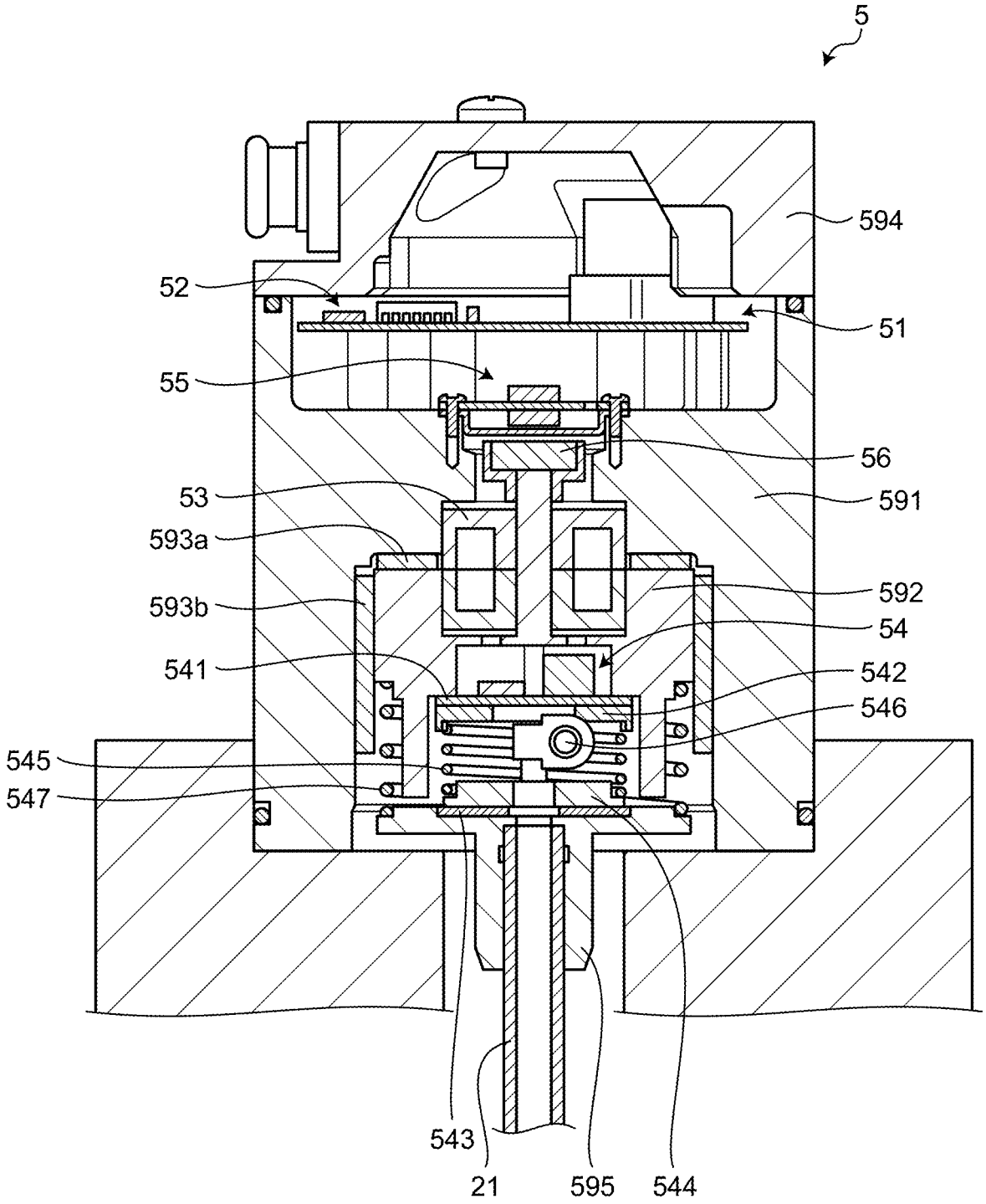
FIG. 3 is a side cross-sectional view illustrating a power feeding unit according to the embodiment.
Figure 4:
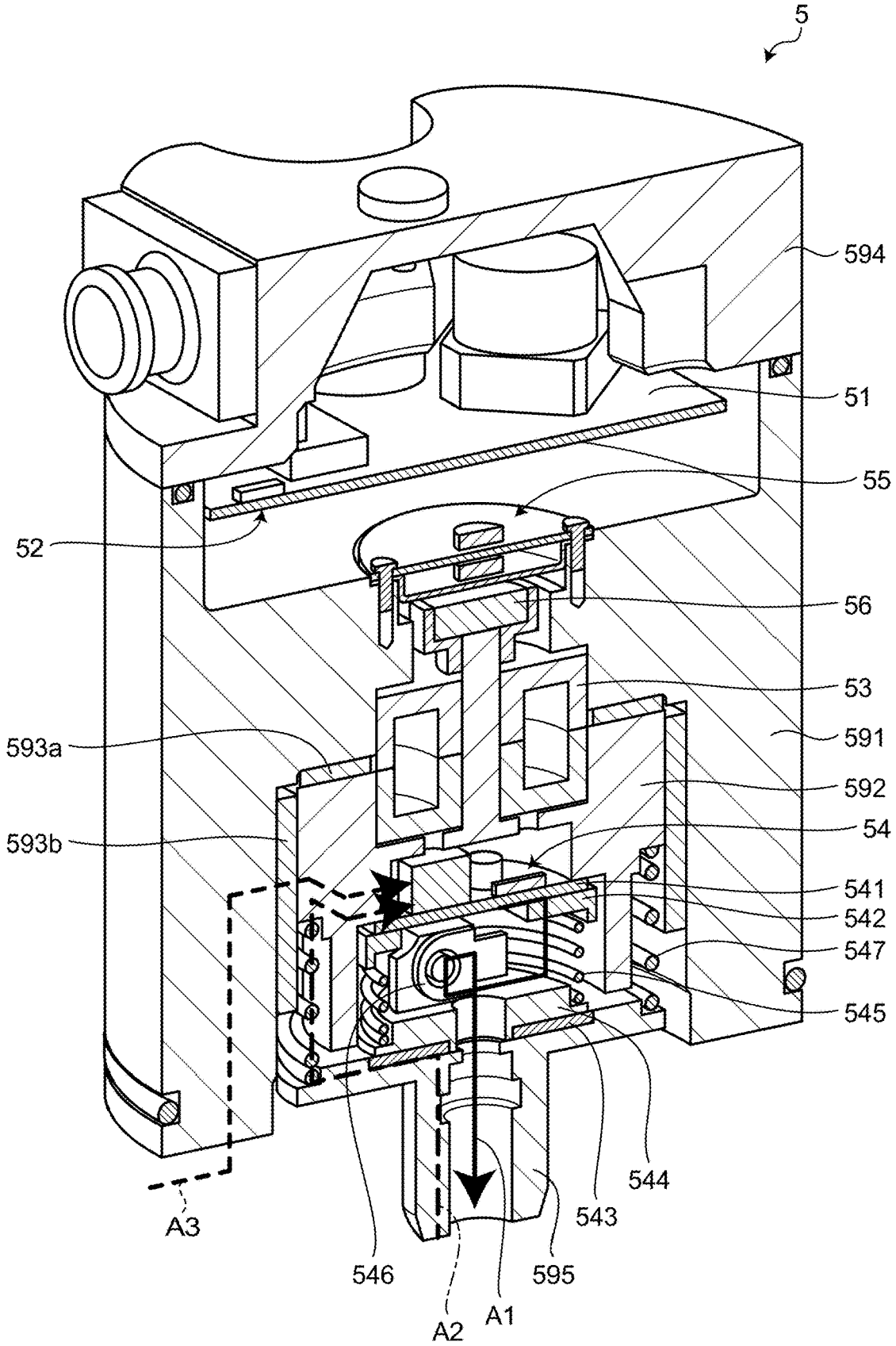
FIG. 4 is a perspective view illustrating the power feeding unit according to the embodiment.
Figure 5:
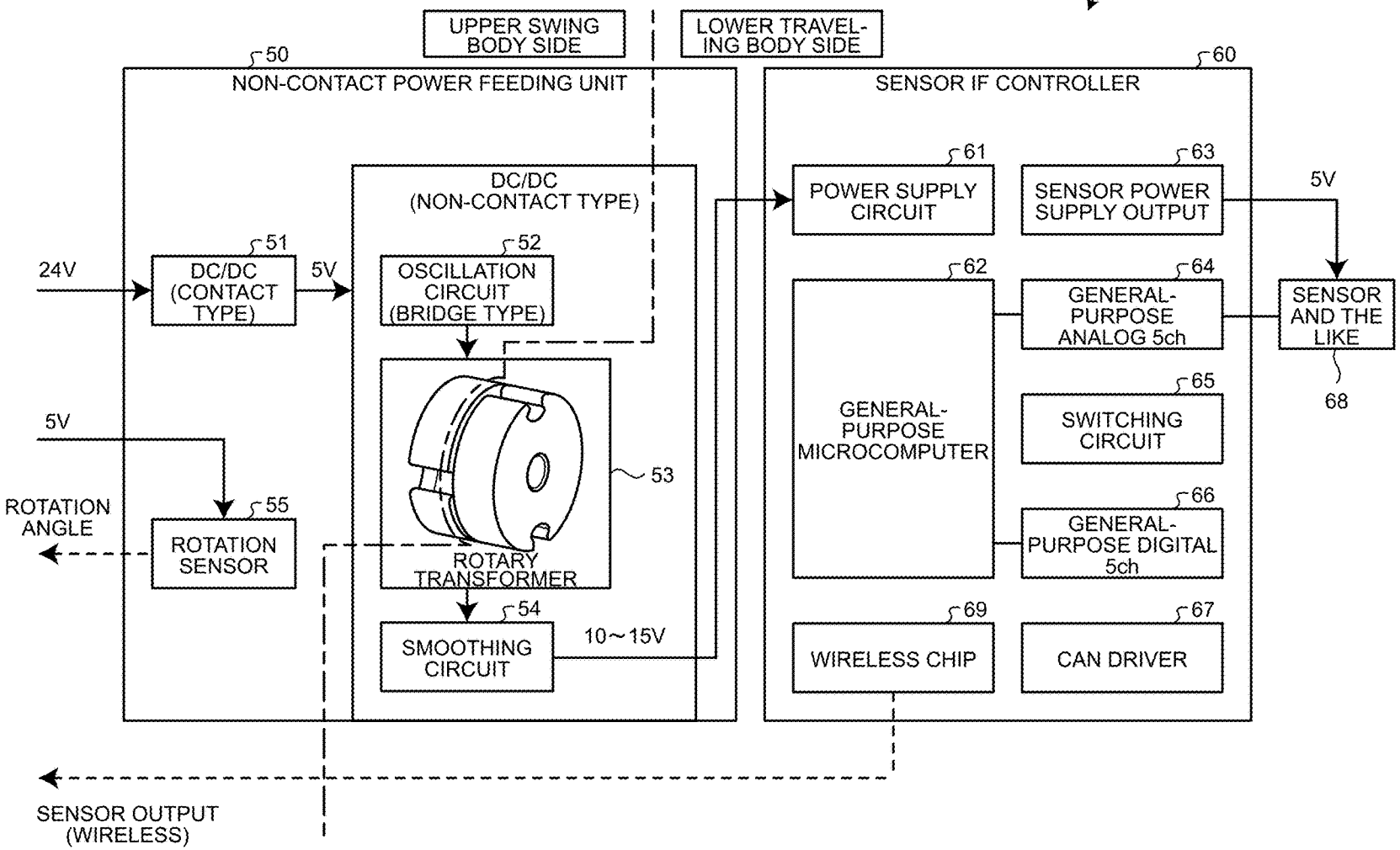
FIG. 5 is a schematic view illustrating the power feeding unit according to the embodiment.

FIG. 3 is a side cross-sectional view illustrating the power feeding unit according to the embodiment. FIG. 4 is a perspective view illustrating the power feeding unit according to the embodiment. FIG. 5 is a schematic view illustrating the power feeding unit according to the embodiment. The power feeding system 5 supplies electric power to the lower traveling body 100. The power feeding system 5 includes a non-contact power feeding unit (hereinafter, referred to as a "power feeding unit") 50 and a sensor interface (IF) controller (hereinafter, referred to as a "controller") 60.

<Power Feeding Unit>

The power feeding unit 50 feeds electric power from the upper swing body 200 side to the lower traveling body 100 side in a non-contact manner. The power feeding unit 50 is mounted on an upper portion of the swivel joint 1. The power feeding unit 50 includes a DC/DC converter 51, an oscillation circuit 52, a rotary transformer 53, a smoothing circuit 54, and a rotation sensor 55.

The DC/DC converter 51 outputs the electric power supplied from the upper swing body 200 side to the oscillation circuit 52. For example, the DC/DC converter 51 converts the supplied direct current of 24 [V] into a direct current of 5 [V] and outputs the direct current. In the embodiment, the DC/DC converter 51 is disposed on an oscillation circuit board disposed above the rotation sensor 55. In the embodiment, the DC/DC converter 51 is disposed on an upper portion of a main body portion 591. In the embodiment, the DC/DC converter 51 is disposed above the rotation sensor 55 and a magnet portion 56.

The oscillation circuit 52 is coupled to the upper swing body 200, converts electric power into an alternating current, and supplies the alternating current to the rotary transformer 53. The oscillation circuit 52 converts the direct current supplied from the DC/DC converter 51 into a high-frequency alternating current. The oscillation circuit 52 outputs the alternating current to the rotary transformer 53. In the embodiment, the oscillation circuit 52 is disposed on the oscillation circuit board disposed above the rotation sensor 55. In the embodiment, the oscillation circuit 52 is disposed on the upper portion of the main body portion 591. In the embodiment, the oscillation circuit 52 is disposed above the rotation sensor 55 and the magnet portion 56.

The rotary transformer 53 is coupled to the upper swing body 200 and the lower traveling body 100. The rotary transformer 53 is disposed coaxially with a rotation axis AX of the swivel joint 1. A central portion of the rotary transformer 53 is hollow, and a small diameter portion, which is a shaft portion of a rotation shaft 592 coaxial with the rotation axis AX of the swivel joint 1, is inserted therethrough. In the embodiment, the rotary transformer 53 is disposed below the oscillation circuit 52. In the embodiment, the rotary transformer 53 is disposed below the rotation sensor 55 and the magnet portion 56. In the embodiment, the rotary transformer 53 is disposed above the smoothing circuit 54. In the embodiment, an upper portion of the rotary transformer 53 is disposed on the main body portion 591 fixed to the upper swing body 200 side. In the embodiment, the upper portion of the rotary transformer 53 protrudes upward from a large diameter portion of the rotation shaft 592. In the embodiment, a lower portion of the rotary transformer 53 is disposed in the large diameter portion of the rotation shaft 592. In the embodiment, the lower portion of the rotary transformer 53 rotates with the rotation shaft 592 when the swivel joint 1 rotates about the rotation axis AX.

The smoothing circuit 54 is coupled to the lower traveling body 100, and converts the alternating current supplied from the rotary transformer 53 into a direct current. The smoothing circuit 54 supplies a direct current of about 10 [V] or more and 15 [V] or less to the lower traveling body 100 side. In the embodiment, the smoothing circuit 54 is disposed on a smoothing circuit board disposed below the rotary transformer 53. In the embodiment, the smoothing circuit 54 is disposed above a spring 545. In the embodiment, the smoothing circuit 54 is disposed above the pipe 21 provided inside a mounting shaft 595 and the shaft 20 of the swivel joint 1.

An electrode on a negative side of the smoothing circuit 54 is electrically coupled to a housing of the lower traveling body 100. An electrode on a positive side of the smoothing circuit 54 is taken out from a lower portion of the swivel joint 1 via a cable inserted through the pipe 21 provided in the swivel joint 1 along the axial direction.

A mounting plate 542, a mounting plate 544, the spring 545, a crimp terminal 546, and a spring 547 are formed of, for example, a conductive material such as a metal material.

The mounting plate 542 is disposed above the mounting plate 544 in the axial direction. The mounting plate 544 is disposed below the mounting plate 542 in the axial direction. The mounting plate 542 and the mounting plate 544 are disposed to face each other while being spaced apart from each other in the axial direction. The mounting plate 542 and the mounting plate 544 sandwich the spring 545 in the axial direction. The mounting plate 542, the mounting plate 544, and the spring 545 are electrically coupled.

The spring 545 is electrically coupled to the electrode on the positive side of the smoothing circuit 54, and transmits a positive voltage. The spring 545 is electrically coupled to the mounting plate 542, the mounting plate 544, and the crimp terminal 546. In the embodiment, the spring 545 is sandwiched between the mounting plate 542 and the mounting plate 544. In the embodiment, the spring 545 is disposed below the smoothing circuit board on which the smoothing circuit 54 is disposed. In the embodiment, the spring 545 is disposed above the pipe 21 provided inside the mounting shaft 595 and the shaft 20 of the swivel joint 1.

The spring 545 is mounted on the rotation shaft 592 and the mounting shaft 595 in a state of being sandwiched between the mounting plate 542 and the mounting plate 544 in the axial direction.

The crimp terminal 546 is the electrode on the positive side of the smoothing circuit 54. The crimp terminal 546 is fixed to the mounting plate 544. The crimp terminal 546 is electrically coupled to the mounting plate 544. The crimp terminal 546 is electrically coupled to the cable inserted into the pipe 21 provided inside the shaft 20 of the swivel joint 1. The surface of the cable is coated with an insulating material. In the embodiment, the crimp terminal 546 is disposed at an intermediate portion between the mounting plate 542 and the mounting plate 544.

The spring 547 is electrically coupled to the electrode on the negative side of the smoothing circuit 54, and transmits a negative voltage (ground voltage). The spring 547 is fixed to an outer peripheral surface of the rotation shaft 592 and an outer peripheral surface of the mounting shaft 595. The spring 547 is electrically coupled to the rotation shaft 592 and the mounting shaft 595. In the embodiment, the spring 547 is disposed below the smoothing circuit board on which the smoothing circuit 54 is disposed. In the embodiment, the spring 547 is disposed above the pipe 21 provided inside the mounting shaft 595 and the shaft 20 of the swivel joint 1.

The mounting plate 542 is fixed to a copper foil portion (not illustrated) exposed on a lower surface of the smoothing circuit board on which the smoothing circuit 54 is disposed by a resin screw (not illustrated). As a result, the copper foil portion on the lower surface of the smoothing circuit board and the mounting plate 542 come into contact with each other and are electrically coupled. Electric power from the smoothing circuit 54 flows to the cable inserted through the pipe 21 provided inside the shaft 20 of the swivel joint 1 via the mounting plate 542, the spring 545, and the crimp terminal 546.

An insulating portion 541 and an insulating portion 543 are formed of a glass epoxy material. The insulating portion 541 and the insulating portion 543 are disposed to face each other while being spaced apart from each other in the axial direction. The insulating portion 541 is disposed in surface contact with an upper surface of the mounting plate 542. The insulating portion 543 is disposed in surface contact with a lower surface of the mounting plate 544. The insulating portion 541 and the insulating portion 543 sandwich the mounting plate 542, the mounting plate 544, the spring 545, and the crimp terminal 546 in the axial direction. The insulating portion 541 electrically insulates the smoothing circuit 54 from the mounting plate 542, the spring 545, and the crimp terminal 546. The insulating portion 543 electrically insulates the mounting plate 544, the spring 545, and the crimp terminal 546 from the mounting shaft 595.

The rotation sensor 55 is a sensor that detects a rotation angle of the rotation axis AX of the swivel joint 1. In the embodiment, the rotation sensor 55 is disposed below the oscillation circuit 52 and above the rotary transformer 53. The rotation sensor 55 is disposed above the pipe 21 provided inside the shaft 20 of the swivel joint 1. The rotation sensor 55 is disposed coaxially with the rotation axis AX of the swivel joint 1. The rotation sensor 55 is disposed at an upper end portion of the rotation shaft 592 disposed coaxially via the mounting shaft 595 on an upper portion of the shaft 20 of the swivel joint 1. The rotation sensor 55 receives electric power from a main controller disposed in the upper swing body 200 via a cable, and outputs sensor data to the main controller via the cable. The rotation sensor 55 has the magnet portion 56. The magnet portion 56 is disposed at the upper end portion of the rotation shaft 592. The magnet portion 56 rotates about the rotation axis AX together with the shaft 20 of the swivel joint 1. A relative rotation angle between the magnet portion 56 and the rotation sensor 55 is detected by a Hall element of the rotation sensor 55.

The main body portion 591, the rotation shaft 592, a bush 593*a*, a bush 593*b*, a lid portion 594, and the mounting shaft 595 are formed of, for example, a conductive material such as a metal material.

The main body portion 591 defines an outer shape of the power feeding unit 50 together with the lid portion 594. The main body portion 591 is formed in a tubular shape. The DC/DC converter 51, the oscillation circuit 52, the rotary transformer 53, the smoothing circuit 54, and the rotation sensor 55 are stored in the main body portion 591. The rotation shaft 592 and the mounting shaft 595 are disposed inside the main body portion 591.

The rotation shaft 592 is disposed inside the main body portion 591. The rotation shaft 592 is disposed on the upper portion of the shaft 20 of the swivel joint 1 coaxially with the rotation axis AX via the mounting shaft 595. The rotation shaft 592 rotates about the rotation axis AX together with the shaft 20 of the swivel joint 1. In the rotation shaft 592, the large diameter portion and the small diameter portion are integrally formed along the axial direction. The large diameter portion of the rotation shaft 592 is disposed axially downward. The lower portion of the rotary transformer 53 and the smoothing circuit 54 are disposed in the large diameter portion of the rotation shaft 592. The small diameter portion of the rotation shaft 592 is a shaft portion coaxial with the rotation axis AX of the swivel joint 1. The small diameter portion of the rotation shaft 592 is disposed axially upward. The rotary transformer 53 is disposed in the small diameter portion of the rotation shaft 592.

The rotation shaft 592 is fixed to the smoothing circuit board on which the smoothing circuit 54 is disposed by screws. The rotation shaft 592 is fixed to a copper foil portion (not illustrated) exposed on an upper surface of the smoothing circuit board with a resin screw (not illustrated). As a result, the copper foil portion on the upper surface of the smoothing circuit board and the rotation shaft 592 come into contact with each other and are electrically coupled to each other.

The bush 593*a* and the bush 593*b* are formed of a metal material. The bush 593*a* is formed of a plate material in a disk shape. The bush 593*a* is interposed between the main body portion 591 and the upper portion of the rotation shaft 592. The bush 593*a* is disposed to cover the upper surface of the large diameter portion of the rotation shaft 592. The bush 593*b* is formed of a plate material in a cylindrical shape. The bush 593*b* is interposed between the main body portion 591 and a radially outer side of the rotation shaft 592. The bush 593*a* is disposed to cover the radially outer side of the rotation shaft 592 of the rotation shaft 592. The bush 593*a* and the bush 593*b* are electrically coupled to the main body portion 591 and the rotation shaft 592.

The lid portion 594 defines an outer shape of the power feeding unit 50 together with the main body portion 591. The lid portion 594 is disposed on the upper portion of the main body portion 591.

The mounting shaft 595 is a shaft for mounting the power feeding unit 50 to the pipe 21 provided inside the shaft 20 of the swivel joint 1. The mounting shaft 595 mounts the power feeding unit 50 to the upper portion of the pipe 21 provided inside the shaft 20 of the swivel joint 1. The mounting shaft 595 is disposed below the rotation shaft 592.

<Controller>

A controller 60 is disposed in the lower traveling body 100. The controller 60 is a working equipment controller that controls various functions of the lower traveling body 100 of the work vehicle MV. The controller 60 includes a power supply circuit 61, a general-purpose microcomputer (MCU: micro controller unit) 62, a sensor power supply output 63, a general-purpose analog IF 64, a switching circuit 65, a general-purpose digital IF 66, a controller area network (CAN) driver 67, a sensor 68, and a wireless chip 69. The configuration of the controller 60 is an example, and is not limited thereto.

The power supply circuit 61 is supplied with a direct current of about 10 [V] or more and 15 [V] or less from the smoothing circuit 54 of the power feeding unit 50. The power supply circuit 61 supplies electric power to each unit of the controller 60.

The MCU 62 is a general-purpose microcontroller. The MCU 62 is coupled to the general-purpose analog IF 64 and the general-purpose digital IF 66 so as to be able to communicate data. In the embodiment, the general-purpose analog IF 64 and the general-purpose digital IF 66 include a plurality of channels.

The sensor power supply output 63 outputs a direct current of about 5 [V] to the sensor 68 and the like disposed in the lower traveling body 100.

The CAN driver 67 is a driver for communicating data with sensors disposed in the lower traveling body 100 via the CAN.

The sensors 68 are various sensors disposed in the lower traveling body 100. The sensor 68 is, for example, a sensor that detects an abnormality of the lower traveling body 100. The sensor 68 is, for example, a sensor that detects vibration of the lower traveling body 100.

The wireless chip 69 communicates data according to a wireless standard such as ZigBee (registered trademark) or TWELITE (registered trademark). In the embodiment, the wireless chip 69 wirelessly outputs sensor data to the main controller disposed in the upper swing body 200.

<Operation>

An operation of the power feeding unit 50 configured as described above, specifically, a flow path of electric power supplied to the lower traveling body 100 by the power feeding unit 50 will be described with reference to FIG. 4.

A current flow path A1 is a current flow path of a positive voltage in the smoothing circuit 54. The current flow path A1 is a flow path of a current of a positive voltage taken out from the lower portion 11 of the swivel joint 1 via the mounting plate 542, the spring 545, the crimp terminal 546, and the cable from the smoothing circuit 54.

A current flow path A2 is a current flow path of a negative voltage in the smoothing circuit 54. The current flow path A2 is a flow path of a current of a negative voltage flowing to the smoothing circuit 54 via the pipe 21 of the swivel joint 1, the mounting shaft 595, the spring 547, and the rotation shaft 592.

A current flow path A3 is another current flow path of a negative voltage in the smoothing circuit 54. The current flow path A3 is a flow path of a current of a negative voltage flowing to the smoothing circuit 54 via the swivel joint 1, the main body portion 591, the bush 593*a*, the bush 593*b*, and the rotation shaft 592.

Effects

As described above, according to the embodiment, the electrode on the negative side of the smoothing circuit 54 is electrically coupled to the housing of the lower traveling body 100. According to the embodiment, the electrode on the positive side of the smoothing circuit 54 is taken out from the lower portion 11 of the swivel joint 1 via the cable inserted through the pipe 21 provided inside the swivel joint 1 along the axial direction. Therefore, according to the embodiment, a one-core cable may be disposed inside the swivel joint 1. For example, when a cable hole is newly provided inside the swivel joint 1, a cross-sectional area occupied by the cable can be made smaller than that in a case of a two-core cable. According to the embodiment, it is possible to reduce an influence on a wall thickness of the hydraulic oil flow path 22 of the swivel joint 1 and to minimize a decrease in strength of the swivel joint 1. Specifically, assuming that a diameter of the two-core cable is $\Phi 2d$, a diameter of the one-core cable is $\Phi d$ or less, and the cross-sectional area is ¼ times. According to the embodiment, a number of cores of the cable can be reduced. According to the embodiment, the swivel joint 1 having a smaller size and a lower cost can be provided. As described above, the embodiment can suppress a decrease in an area of the hydraulic oil flow path 22 of the swivel joint 1 and minimize an increase in pressure loss. The embodiment can suppress a decrease in strength of the swivel joint 1.

In the embodiment, the rotary transformer 53 can be disposed coaxially with the rotation axis AX of the swivel joint 1. In the embodiment, the rotary transformer 53 can be disposed at an appropriate position.

In the embodiment, the rotation sensor 55 that detects the rotation of the swivel joint 1 can be disposed. In the embodiment, it is possible to transmit electric power to the lower traveling body 100 side and detect the rotation of the swivel joint 1.

In the embodiment, the rotation sensor 55 can be disposed coaxially with the rotation axis AX of the swivel joint 1. In the embodiment, the rotation sensor 55 can be disposed at an appropriate position.

In the embodiment, the smoothing circuit 54 can be disposed below the rotary transformer 53. In the embodiment, the smoothing circuit 54 can be disposed at an appropriate position. According to the present embodiment, electric power can be supplied to the lower traveling body side by a one-core cable.

In the embodiment, the rotary transformer 53 can be disposed below the oscillation circuit 52. In the embodiment, the rotary transformer 53 can be disposed at an appropriate position.

In the embodiment, the rotation sensor 55 can be disposed below the oscillation circuit 52 and above the rotary transformer 53. In the embodiment, the rotation sensor 55 can be disposed at an appropriate position.

Modification

The disposition of the rotary transformer 53 and the rotation sensor 55 in the power feeding unit 50 is not limited to the above. The rotary transformer 53 may be disposed above the rotation sensor 55.

REFERENCE SIGNS LIST

1 SWIVEL JOINT
5 POWER FEEDING SYSTEM
10 ROTOR
20 SHAFT
21 PIPE
22 HYDRAULIC OIL FLOW PATH
30 OIL PATH
50 NON-CONTACT POWER FEEDING UNIT (POWER FEEDING UNIT)
51 DC/DC CONVERTER
52 OSCILLATION CIRCUIT
53 ROTARY TRANSFORMER
54 SMOOTHING CIRCUIT
55 ROTATION SENSOR
56 MAGNET PORTION
60 SENSOR IF CONTROLLER (CONTROLLER)
61 POWER SUPPLY CIRCUIT
62 GENERAL-PURPOSE MICROCOMPUTER (MCU)
63 SENSOR POWER SUPPLY OUTPUT
64 GENERAL-PURPOSE ANALOG IF
65 SWITCHING CIRCUIT
66 GENERAL-PURPOSE DIGITAL IF
67 CAN DRIVER
68 SENSOR
69 WIRELESS CHIP
100 LOWER TRAVELING BODY
101 TUBE
102 HYDRAULIC MOTOR
200 UPPER SWING BODY
201 TUBE
202 HYDRAULIC PUMP
203 HYDRAULIC OIL TANK
204 OIL PATH
300 ROTATION MECHANISM
301 INNER RING MEMBER
302 OUTER RING MEMBER
541 INSULATING PORTION
542 MOUNTING PLATE
543 INSULATING PORTION
544 MOUNTING PLATE
545 SPRING
546 CRIMP TERMINAL
547 SPRING
591 MAIN BODY PORTION
592 ROTATION SHAFT
593*a* BUSH
593*b* BUSH
594 LID PORTION
595 MOUNTING SHAFT
AX SWING AXIS
MV WORK VEHICLE

The invention claimed is:

1. A power feeding unit mounted on a swivel joint of a work vehicle, the power feeding unit comprising:

a rotary transformer that is coupled to each of an upper swing body and a lower traveling body of the work vehicle;

an oscillation circuit that is coupled to the upper swing body, converts electric power into an alternating current, and supplies the alternating current to the rotary transformer; and a smoothing circuit that is coupled to the lower traveling body and converts electric power output from the rotary transformer into a direct current, wherein an electrode on a negative side of the smoothing circuit is electrically coupled to a housing of the lower traveling body, and an electrode on a positive side of the smoothing circuit is taken out from a lower portion of the swivel joint via a cable inserted through a pipe provided inside the swivel joint along an axial direction.

2. The power feeding unit according to claim 1, wherein the rotary transformer is disposed coaxially with a rotation axis of the swivel joint.

3. The power feeding unit according to claim 1, further comprising:

a rotation sensor that detects rotation of the swivel joint.

4. The power feeding unit according to claim 3, wherein the rotation sensor is disposed coaxially with a rotation axis of the swivel joint.

5. The power feeding unit according to claim 1, wherein the smoothing circuit is disposed below the rotary transformer.

6. The power feeding unit according to claim 5, wherein the rotary transformer is disposed below the oscillation circuit.

7. The power feeding unit according to claim 4, wherein the rotation sensor is disposed below the oscillation circuit and above the rotary transformer.

8. A swivel joint comprising:

the power feeding unit according to claim 1;

a rotor;

a shaft disposed in a bore of the rotor; and a hydraulic oil flow path provided inside the shaft along an axial direction.

9. A swivel joint comprising:

the power feeding unit according to claim 2;

a rotor;

a shaft disposed in a bore of the rotor; and a hydraulic oil flow path provided inside the shaft along an axial direction.

10. A swivel joint comprising:

the power feeding unit according to claim 3;

a rotor;

a shaft disposed in a bore of the rotor; and a hydraulic oil flow path provided inside the shaft along an axial direction.

11. A swivel joint comprising:

the power feeding unit according to claim 4;

a rotor;

a shaft disposed in a bore of the rotor; and a hydraulic oil flow path provided inside the shaft along an axial direction.

12. A swivel joint comprising:

the power feeding unit according to claim 5;

a rotor;

a shaft disposed in a bore of the rotor; and a hydraulic oil flow path provided inside the shaft along an axial direction.

13. A swivel joint comprising:

the power feeding unit according to claim 6;

a rotor;

a shaft disposed in a bore of the rotor; and a hydraulic oil flow path provided inside the shaft along an axial direction.

14. A swivel joint comprising:

the power feeding unit according to claim 7;

a rotor;

a shaft disposed in a bore of the rotor; and a hydraulic oil flow path provided inside the shaft along an axial direction.

15. A swivel joint comprising:

the power feeding unit according to claim 8;

a rotor;

a shaft disposed in a bore of the rotor; and a hydraulic oil flow path provided inside the shaft along an axial direction.

* * * * *